United States Patent [19]

Sloan

[11] Patent Number: 4,574,501

[45] Date of Patent: Mar. 11, 1986

[54] IN-PLACE UNDERWATER DREDGING APPARATUS OF THE CRATER SINK TYPE

[76] Inventor: Albert H. Sloan, 201 Kean Rd., Ft. Lauderdale, Fla. 33314

[21] Appl. No.: 689,189

[22] Filed: Jan. 7, 1985

[51] Int. Cl.[4] ..... E02B 3/02; E02F 3/88

[52] U.S. Cl. ..... 37/58; 37/66; 405/74

[58] Field of Search ..... 405/74; 37/66, 64, 58, 37/65, 65, 67

[56] References Cited

U.S. PATENT DOCUMENTS

| | | | |
|---|---|---|---|
| 3,638,432 | 2/1972 | Schoonmaker | 405/74 |
| 4,074,535 | 2/1978 | Schoonmaker | 405/74 |
| 4,217,212 | 8/1980 | Deal | 37/66 X |
| 4,312,762 | 1/1982 | Blackburn et al. | 37/64 X |

*Primary Examiner*—Clifford D. Crowder
*Attorney, Agent, or Firm*—James E. Nilles

[57] ABSTRACT

In-place underwater dredging apparatus for dredging solid material from an underwater area by pumping a mixture of water and solids from the area and discharging the mixture at a remote location to thereby clear and deepen the area. The apparatus includes an upstanding pipe having at its upper end a hydraulically driven pump with a discharge conduit for conducting said mixture to a remote location, auger screws extending generally laterally outwardly from the lower end of said upstanding pipe and delivering material at a selected rate to the upstanding pipe, and a variable speed hydraulic motor connected with and for rotating said auger screws. Thus the percentage of solids to water which is delivered is variable depending on variable conditions and circumstances. The pump draws the mixture from the auger screws and through the upstanding pipe and discharges it at a remote location. The apparatus also includes a dirty water intake pipe for dredge water which fluidizes the material coming from the auger screws and resulting in easier handling by the pump. The apparatus also includes a clean water intake pipe for insuring the system is clean before starting and can be purged after use.

9 Claims, 8 Drawing Figures

IN-PLACE UNDERWATER DREDGING APPARATUS OF THE CRATER SINK TYPE

BACKGROUND OF THE INVENTION

Certain underwater areas of harbors, inlets or other waterways must periodically be dredged of sand or other solid material so as to maintain a certain depth of the waterbed for the safe passage of water craft. These channels or other harbor areas continually fill with sand due to the wave action tide or the like and heretofore it has been the practice to periodically clear the area when the height of the solid material reached a certain level. This periodic cleaning of the areas was not satisfactory because of time and effort required to set and remove the dredging equipment, and furthermore because of the different and varying time intervals required for the area to become filled with sand to a point where it must be cleared out. Another shortcoming of this prior art dredging process was that it was not done uniformly and to the same extent each time, resulting in unpredictable safe passage of the water craft. Certain areas of the harbor, channel or inlet waterways became filled more rapidly then others and these particular areas required more frequent attention.

SUMMARY OF THE PRESENT INVENTION

The present invention provides underwater dredging apparatus including a generally vertical or upstanding pipe having a hydraulically driven pump adjacent its upper end and having a discharge conduit for conducting a mixture of solids and water to a remote location, auger means extend generally laterally outwardly from the lower end of said vertical pipe and means in the form of a variable speed, reversible hydraulic motor are used to rotate the auger means at a speed selected depending on the feed rate desired. The auger means thereby convey the solids and water towards the vertical pipe and then upwardly through the vertical pipe and out of the pump to a remote location. Thus the auger means acts to meter the solids, that is meter the percentage of solids being conveyed, depending on the circumstances.

The invention also contemplates a dirty water intake pipe for fluidizing the solid material to cause the material to flow and to make it easier for the pump to handle. Also included is a clean water intake pipe for filling the pump and discharge pipe with clean water prior to use thereby preparing the apparatus for pumping the mixture of solids and dirty water, and for flushing the pump and the discharge outlet after use.

A more limited aspect of the invention contemplates that the auger means comprises tubes extending radially outwardly from the lower end of the vertical pipe and in a generally horizontal direction, the tubes having rotatable auger screws therein for feeding the solid material to the lower end of the vertical pipe for conveyance upwardly therein to the discharge conduit. The apparatus rests on the bottom of the waterbed and can be started whenever desirable and after solids have accumulated to thereby again deepen the area to the desired level.

The invention also contemplates a hydraulic fluid power source which can be located remotely from the area to be dredged, for example, up on the adjacent shoreline and this power source has fluid conduits connecting its fluid pressure pump with the hydraulic pump on top of the vertical pipe and also with a hydraulic motor that drives the auger means.

A more specific aspect of the invention contemplates the use of high pressure water jets at the intake portions of the auger means to thereby fluidize and keep the solid material moving from the surrounding area and into the inlet of the auger means.

These and other objects and advantages of the present invention will appear hereinafter as this disclosure progresses, reference being had to the accompanying drawings.

DESCRIPTION OF A PREFERRED EMBODIMENT

Figure 3:
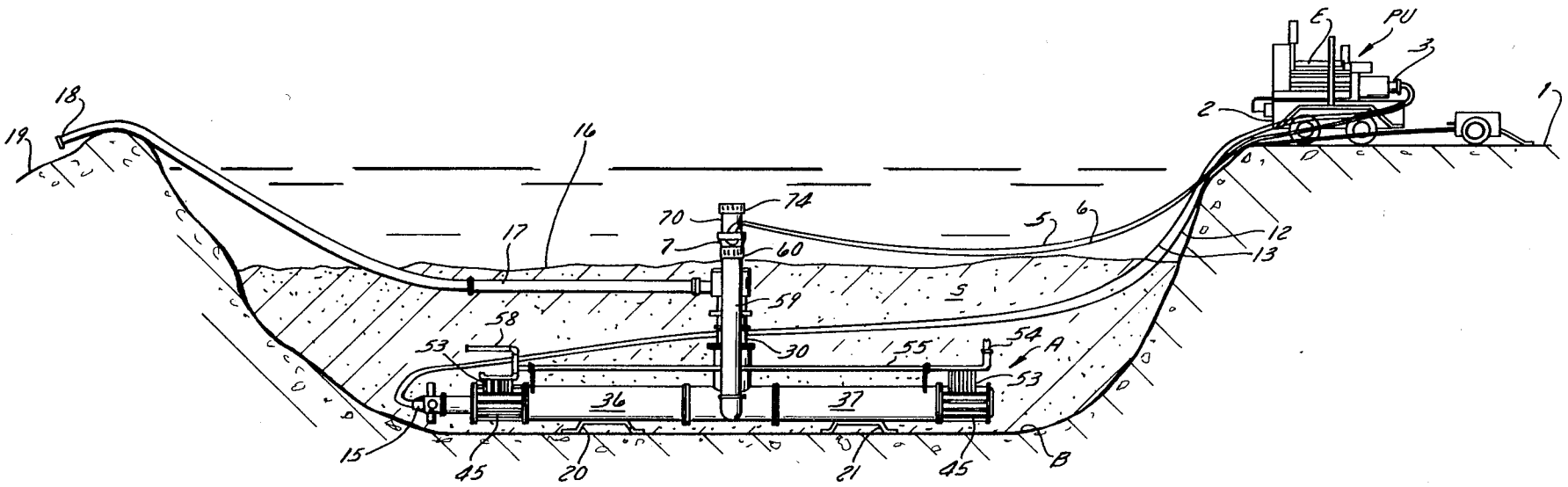
FIG. 3 is a cross-sectional view through a typical harbor channel and showing the underwater dredging apparatus in place and covered with solid material such as sand which is to be removed, and furthermore showing the power unit up on the shoreline and connected to the apparatus by means of the hydraulic conduits.

The arrangement shown in FIG. 3 is a typical installation in a channel. It should be noted, however, that the auger means can extend radially outwardly in any pattern and in any number or in any lengths. The apparatus A sets on the bottom B of the channel or waterbed and the sand S or the solid material is to be removed. It will be understood that the term solid material includes various matter, such as for example, sand, mud, gravel or other material. A power unit PU sets on the shore 1 and may consist of an internal combustion engine E on a portable carriage 2 and includes a pressure fluid pump 3 that furnishes pressurized fluid through conduits 5 and 6, to and from a hydraulic pump 7 and a heat exchanger 8 of the apparatus. Pressure fluid is also furnished to and returned from, via lines 12 and 13, a variable speed, reversible hydraulic motor 15 of the apparatus. A discharge conduit 17 extends from the discharge side of the pump 7 and its end 18 discharges in a catchment 19 or other remote location. Stabilizing mounting structure 20 and 21, may be secured to and extend transversely across the bottom of the apparatus A so as to provide stability and prevent its shifting or tilting.

Generally, the apparatus A is installed in the area while the area is clean and is positioned at its desired depth. Thereafter, the apparatus can be left in place and operated whenever the level of the sand rises to a level where it must be removed.

Figures 1, 2, 4, 5, 7:
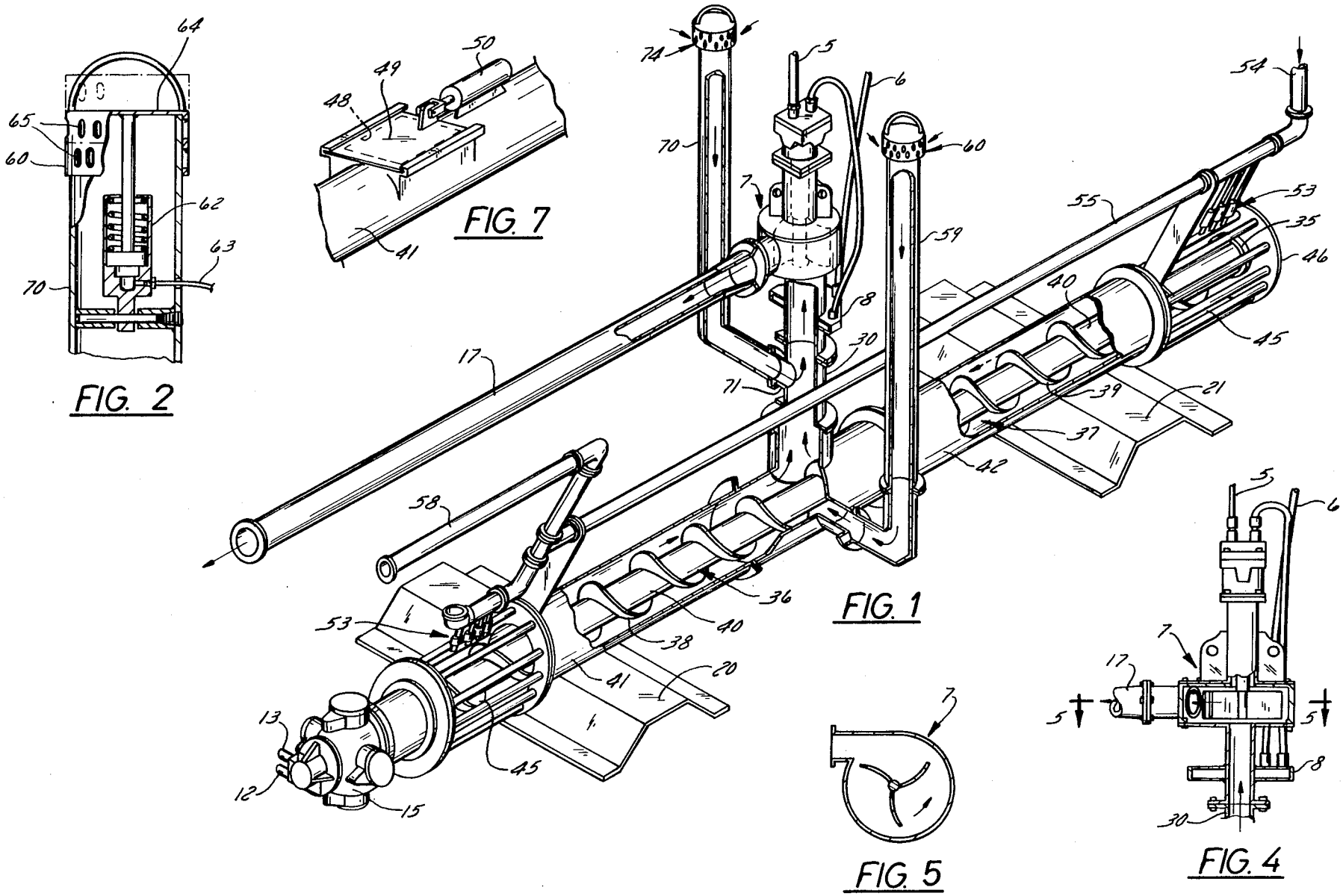
FIG. 1 is a perspective view of one embodiment of underwater dredging apparatus, certain portions being shown as broken away, in section or removed for the sake of clarity in the drawings; the view shows one form of the invention in which the auger means extend radially outwardly on a common axis and in two different directions from the vertical pipe.
FIG. 2 is an enlarged, fragmentary cross-sectional view of the upper ends of the clean water inlet and dirty water inlets and which show the spring return, hydraulically actuated cylinder for opening and closing the inlets.
FIG. 4 is an elevated view, partially in section of the pump.
FIG. 5 is a horizontal cross sectional view of the pump.
FIG. 7 is a fragmentary perspective view of a modified form of material inlet to the auger means.

Referring in greater detail to the apparatus A as shown in FIG. 1, it consists of a vertical pipe 30 having the said hydraulically driven pump 7 fixed at its upper end and from which the said conduits 5 and 6 extend.

The lower end of the vertical pipe 30 is in communication with auger means 36 and 37 which radiate generally laterally outwardly from the lower end of pipe 30 and are in material delivering communication with the vertical pipe. Auger means 36 and 37 include their respective rotatable screws 38 and 39 which in this embodiment are secured to a common shaft 40 which is journalled by the motor 15, and mounted in steel tubes 41 and 42. Tubes 41 and 42 at their inner ends are in material delivering communication with the lower end of vertical pipe 30. In the embodiment shown in FIG. 1, the flights of the screws are pitched so that either one acts to selectively convey material to the vertical pipe while the other inactive in respect to its pumping function depending on the direction of rotation. The auger means shaft 40 and screws are driven, at the desired speed, at one end by the variable speed, reversible hydraulic motor 15 drivingly engaged with shaft 40.

Figure 6:
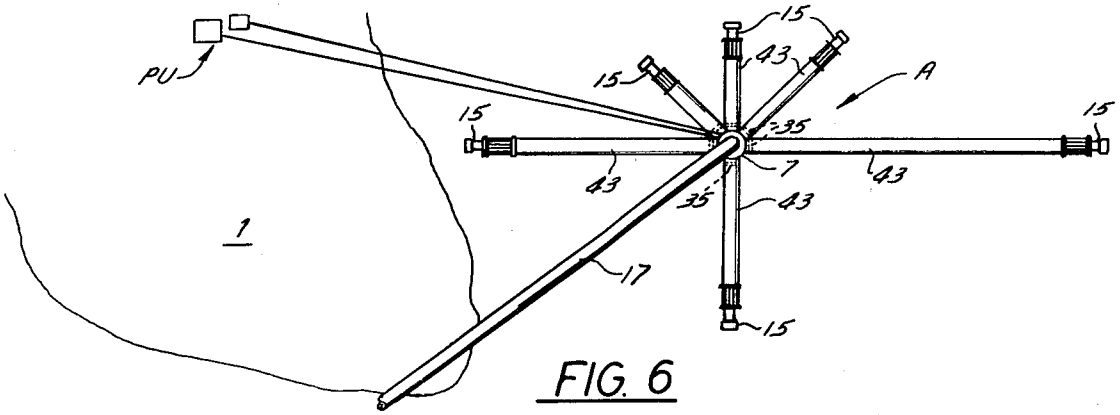
FIG. 6 is a schematic plan view of a modified layout for the auger means.

As shown in FIG. 6, it will be understood that any number of auger means 43 can be used and in any pattern, disposition or length. A motor 15 is provided at the outer end of each auger means and a bearing 35 at the inner ends.

A portion of the outer ends of the auger tubes may have a series of bars 45 or other debris restricting elements 46 at their outer ends.

Figure 8:
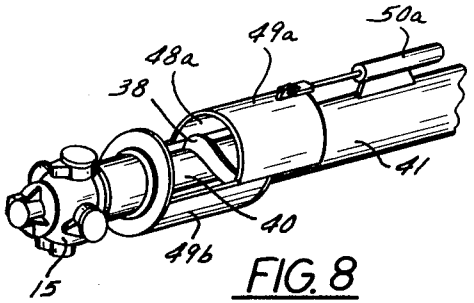
FIG. 8 is a fragmentary perspective view of a modified form of inlet for the end of the auger means.

As shown in FIG. 8, adjustable doors **49*a* are preferably provided at the upper sides of the ends to vary the amount or location of solids entering the inside of the auger means. Hydraulic cylinders 50*a* actuate the doors. The lower portion of the end is covered by the semicylindrical fixed shield 49*b*. In this manner, the sand or other solid material can enter the outer ends of the augers for conveyance by the rotating screw. As shown in FIG. 7, other or additional forms of material inlets of course may be provided, for example, elongated slots 48 along the length of the auger tube. These slots may have adjustable, sliding doors 49 actuated by hydraulic cylinders 50**. In this manner, the entry of material into the tubes can be regulated.

In order to aid in fluidizing the solid material and to keep the solid material moving into the augers, a waterjet means 53 may be provided at either auger means inlet. High pressure water is delivered via the common inlet pipes 54 and 55 which receive pressurized water from a source (not shown) on the shore. An additional high pressure pipe 58 may be provided at the other end of pipe 55.

In the FIG. 1 embodiment, the motor 15 acts to rotate the auger means in one direction or the other, causing either auger means 36 or 37 to feed the mixture of solid material and water into the vertical pipe 30.

Means are provided for further fluidizing the solid material and this takes the form of a generally vertically extending pipe 59 which has its lower end in communication with the juncture between the auger means and the upstanding pipe 30. This pipe 59 has an upper end through which dredge water, commonly referred to as dirty or dredge water, is taken in, in the amount desired or necessary. The amount of dirty or dredge water intake is regulated by the valve 60 which in turn is operated by the spring loaded hydraulically actuated hydraulic cylinder 62. Hydraulic fluid coming in line 63 acts to cause the valve cover 64 to rise thereby permitting ingress of water through the holes 65 of the cover. When pressure is relieved from conduit 63, the spring returns the valve to the shut position.

On the other side of the upstanding pipe is located a clean water inlet pipe 70 having its discharge end in communication with the upwardly extending pipe 30, as at 71, and intermediate the height of the pipe 30 but located beneath the pump 7. The upper end of the clean water inlet 70 also has a regulatable valve 74 (similar to valve 60) which can be opened in varying degrees to vary the amount of clean water induced or admitted into the vertical pipe 30. The height of the clean water inlet is higher than the height of the dirty water inlet and insures that clear or clean water, relatively speaking, is introduced for cleaning or purging the pump and the discharge pipe.

The operation of the apparatus is as follows:

To start the apparatus once it is securely in place, the clear water inlet 70 is opened and the auger feed screw is not rotating. The pump 7 then acts to draw clear water through it and through the discharge pipe thereby insuring that the system is clear and ready for operation. After a suitable warmup period the system is put on the line by opening the dirty water then actuating the motor 15 and auger means. The clear water inlet 70 is then shut and the auger means commences turning and slowly bringing it up to desired speed. At the same time the dredge water inlet 60 is opened to the degree necessary, and whenever necessary, to insure fluidization of the material for proper handling by the pump 7.

The percentage of solids to water to be conveyed depends on different circumstances and conditions for example, the depth to which the apparatus is buried, and the amount and character of the solids. The auger means acts as a rotary valve because of its variable rotational speed by means of which the amount and percentage of solids can be controlled. This is important and enables the apparatus to continue functioning under adverse conditions.

During operation it may be desirable to introduce high pressure water into the water jets 53 thereby further aiding in feeding the solid material into the auger means and keeping it moving therein. To shut down the apparatus, the rotation of the auger screws would be stopped, if doors are used, they are closed, and the clear water inlet 70 fully opened and the pump 7 allowed to run in that condition for a few minutes to be sure the pump and the discharge line are purged of material. The pump is slowed to idle and stopped and the clear water suction is then closed.

RECAPITULATION

The dredging apparatus of the present invention is permanently located in a crater sink or other area to be maintained free of solid material and the apparatus can remain in place and is operative whenever desired. It can either run periodically as necessary or continually, depending on the movement of the solids in that area of the waterway. The present apparatus is particularly efficient and effective in clearing the underwater area of solids and is reliable in operation and requires relatively minor maintenance.

What is claimed as the invention is:

1. Underwater dredging apparatus for dredging solid material from an underwater area by pumping a mixture of water and solids from the area and discharging the mixture at a remote location to thereby clear and deepen the area, said apparatus comprising, a generally vertically upstanding pipe having a hydraulically driven pump adjacent its upper end, and said upstanding pipe having a lower end located beneath the surface of the water, said pump having a discharge conduit for conducting said mixture to a remote location, and tubular auger means including a tube and an auger screw rotatably mounted therein and extending generally horizontally and laterally outwardly from the lower end of said upstanding pipe and in direct and positive material delivering communication therewith; a variable speed hydraulic motor connected with said auger screw for rotatably driving said auger screw to deliver and meter material at a selected rate directly and positively into said upstanding pipe whereby said pump draws said mixture upwardly through said upstanding pipe and discharges it through said discharge conduit to said remote location.

2. The apparatus set forth in claim 1 further characterized in that said tube has an inner end in material delivering communication with the lower end of said upstanding pipe, and said auger screw rotatably journalled in said tube has a flight with a pitch that delivers material to said upstanding pipe when rotating in one direction.

3. The apparatus described in claim 1 including a hydraulic fluid power source located remotely from said area, and fluid conduits connecting said source with said hydraulic pump and with said hydraulic motor.

4. The apparatus set forth in claim 1 further characterized in that said auger means includes tubes extending in different directions, shaft means extending through said tubes and driven by said hydraulic motors, said motor being reversible as to its driving direction, and an auger screw on said shaft means and in each of said tubes, whereby said auger screws feed and meter material selectively into said upstanding pipe.

5. Underwater dredging apparatus for dredging solid material from an underwater area by pumping a mixture of water and solids from the area and discharging the mixture at a remote location to thereby clear and deepen the area, said apparatus comprising, a generally vertically upstanding pipe having a hydraulically driven pump adjacent its upper end, and said upstanding pipe having a lower end located beneath the surface of the water, said pump having a discharge conduit for conducting said mixture to a remote location, tubular auger means including a tube and an auger screw rotatably mounted therein and extending generally horizontally and laterally outwardly from the lower end of said upstanding pipe and in direct and positive material delivering communication therewith; variable speed hydraulic motor means connected with said auger screw for rotatably driving said auger screw to deliver and meter material at a selected rate directly into said upstanding pipe;

whereby said pump draws said mixture directly from said tubular auger means, upwardly through said upstanding pipe and discharges it through said discharge conduit to said remote location, said tubular auger means including a plurality of said tubes and auger screws extending in different directions, shaft means extending through said tubes and having said auger screws secured to said shaft means, said shaft means being driven by said hydraulic motor means, a hydraulic fluid power source located remotely from said area, and fluid conduits connecting said source with said hydraulic pump and with said hydraulic motor means.

6. Underwater dredging apparatus for dredging of solid material from an underwater area by pumping a mixture of water and solids from the area and discharging the mixture at a remote location to thereby clear and deepen the area, said apparatus comprising, a generally vertical upstanding pipe having a hydraulically driven pump adjacent its upper end, and said upstanding pipe having a lower end located beneath the surface of the water, said pump having a discharge conduit for conducting said mixture to a remote location, tubular auger means including a tube and an auger screw rotatably mounted therein and extending generally horizontally and laterally outwardly from the lower end of said upstanding pipe and in material metering and delivering communication therewith; variable speed hydraulic motor means connected with said auger screw for rotatably driving said auger screw; whereby said pump draws said mixture directly from said tubular auger means, upwardly through said upstanding pipe and discharges it through said discharge conduit to said remote location, an upwardly extending dirty water intake pipe having a closable upper end and having its lower end communicating with said tubular auger means and said upstanding pipe adjacent the juncture of said tubular auger means and said upstanding pipe whereby said dredge water fluidizes the material coming from said tubular auger means and for easier handling by said pump, and a clean water intake pipe having a closable upper end above the upper end of said dirty water intake pipe, said clean water intake pipe having its lower discharge end in water delivering communication with said upstanding pipe intermediate the height of the latter and below said pump, whereby clean water acts to purge said pump and discharge pipe prior to dredging solid material, and to clean said pump and discharge pipe after use.

7. The apparatus set forth in claim 6 further characterized in that said tube has an inner end in communication with the lower end of said upstanding pipe, and said auger screw is secured to a shaft which is rotatably journalled in said tube, said auger screw has a pitch that delivers material to said upstanding pipe when rotating in one direction, said shaft being driven by said hydraulic motor means.

8. The apparatus described in claim 6 including a hydraulic fluid power source located remotely from said area, and fluid conduits connecting said source with said hydraulic pump and with said hydraulic motor means.

9. The apparatus set forth in claim 6 further characterized in that said auger means includes a plurality of tubes extending in different directions, a shaft extending through each of said tubes and driven by said hydraulic motor means, and an auger screw on each of said shafts and in each of said tubes, whereby said screws meter and feed material into said upstanding pipe selectively one at a time.

* * * * *